US006860574B2

(12) United States Patent
Hwang et al.

(10) Patent No.: US 6,860,574 B2
(45) Date of Patent: Mar. 1, 2005

(54) POSITIONING DEVICE FOR A SLIDE-AIDING MEMBER FOR A DRAWER TRACK DEVICE

(75) Inventors: Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/352,143

(22) Filed: Jan. 28, 2003

(65) Prior Publication Data

US 2004/0145285 A1 Jul. 29, 2004

(51) Int. Cl.[7] ..... A47B 88/00

(52) U.S. Cl. ..... 312/334.44; 312/334.17; 312/334.11; 312/334.46; 384/18

(58) Field of Search ..... 312/330.1, 334.1, 312/334.7, 334.8, 334.11, 334.17, 334.38, 334.36, 334.44, 334.46; 384/18, 20, 21

(56) References Cited

U.S. PATENT DOCUMENTS 3,738,716 A * 6/1973 Lambert ..... 384/18
5,484,209 A * 1/1996 Weng ..... 384/18
5,507,571 A * 4/1996 Hoffman ..... 312/334.8
5,577,821 A * 11/1996 Chu ..... 312/334.11
5,733,026 A * 3/1998 Munachen ..... 312/334.12
6,220,683 B1 * 4/2001 Chu ..... 312/334.44
6,254,210 B1 * 7/2001 Parvin ..... 312/334.46
6,350,001 B1 * 2/2002 Chu ..... 312/334.44
6,379,045 B1 * 4/2002 Cirocco ..... 384/18
6,557,960 B2 * 5/2003 Shih ..... 312/334.5
6,655,763 B2 * 12/2003 Judge et al. ..... 312/334.46

* cited by examiner

*Primary Examiner*—Peter M. Cuomo
*Assistant Examiner*—Sarah C. Burnham
(74) *Attorney, Agent, or Firm*—Bacon & Thomas PLLC

(57) ABSTRACT

A track device includes a first track, a second track, and a slide-aiding member mounted between the first track and the second track. The first track includes a stop member on a front end thereof. The stop member of the first track and a front end of the slide-aiding member are so configured that the slide-aiding member is retained in place by the stop member of the first track when the second track is removed from the first track. Thus, the second track can be accurately reinserted into the slide-aiding member that is retained in place.

4 Claims, 5 Drawing Sheets

POSITIONING DEVICE FOR A SLIDE-AIDING MEMBER FOR A DRAWER TRACK DEVICE

BACKGROUND OF THE INVENTION

1. Field of the Invention

The present invention relates to a positioning device for a slide-aiding member for a drawer track device. In particular, the present invention relates to a positioning device for temporarily retaining a slide-aiding member of a track device of a drawer.

2. Description of Related Art

FIG. 1 of the drawings illustrates a conventional multi-track device for a drawer. The multi-track device includes at least a first track 11, a second track 12 received in the first rack 11, and a slide-aiding member 13 mounted between the first track 11 and the second track 12. The slide-aiding member 13 allows smooth, reciprocal sliding movement of the second track 12 relative to the first track 11. A stop member 14 is provided on a front end of the first track 11 to prevent the slide-aiding member 13 from being disengaged from the first track 11. A stop 121 is provided on a front end of the second track 12 for pressing against the stop member 14 when the second track 12 is pushed inward, thereby preventing excessive inward movement of the second track 12 relative to the first track 11.

In a case that the second track 12 is disengaged from the first track 11, it is difficult to accurately reinsert the rear end 122 of the second track 12 into the slide-aiding member 13 that slides freely in the first track 11, as there is no means for temporarily retaining the slide-aiding member 13 in place. Further, the front end of the slide-aiding member 13 might be deformed and damaged by the rear end 122 of the second track 12 during reinsertion of the second track 12 into the first track 11. As a result, some of the rolling balls 131 of the slide-aiding member 13 fall from the slide-aiding member 13, which results in a decrease in the utility, and the life of the track device is shortened accordingly.

OBJECTS OF THE INVENTION

An object of the present invention is to provide a positioning device for temporarily retaining a slide-aiding member of a track device of a drawer, allowing a second track of the track device to be accurately reinserted into the slide-aiding member.

Another object of the present invention is to provide a positioning device for temporarily retaining a slide-aiding member of a track device of a drawer, wherein the first track includes a track having two hooks for releasably engaging with two holes in the slide-aiding member to thereby avoid damage to a front end of the slide-aiding member resulting from impingement of the second track upon the front end of the slide-aiding member, thereby prolonging the life of the track device.

SUMMARY OF THE INVENTION

To achieve the aforementioned objects, the present invention provides a track device including a first track, a second track, and a slide-aiding member mounted between the first track and the second track. The first track includes a stop member on a front end thereof. The stop member of the first track and a front end of the slide-aiding member are so configured that the slide-aiding member is retained in place by the stop member of the first track when the second track is removed from the first track. Thus, the second track can be accurately reinserted into the slide-aiding member that is retained in place.

Other objects, advantages and novel features of this invention will become more apparent from the following detailed description when taken in conjunction with the accompanying drawings.

DETAILED DESCRIPTION OF THE PREFERRED EMBODIMENT

The present invention is now to be described hereinafter in detail, in which the same referential numerals are used for the same parts as those in the prior art.

Figure 1:
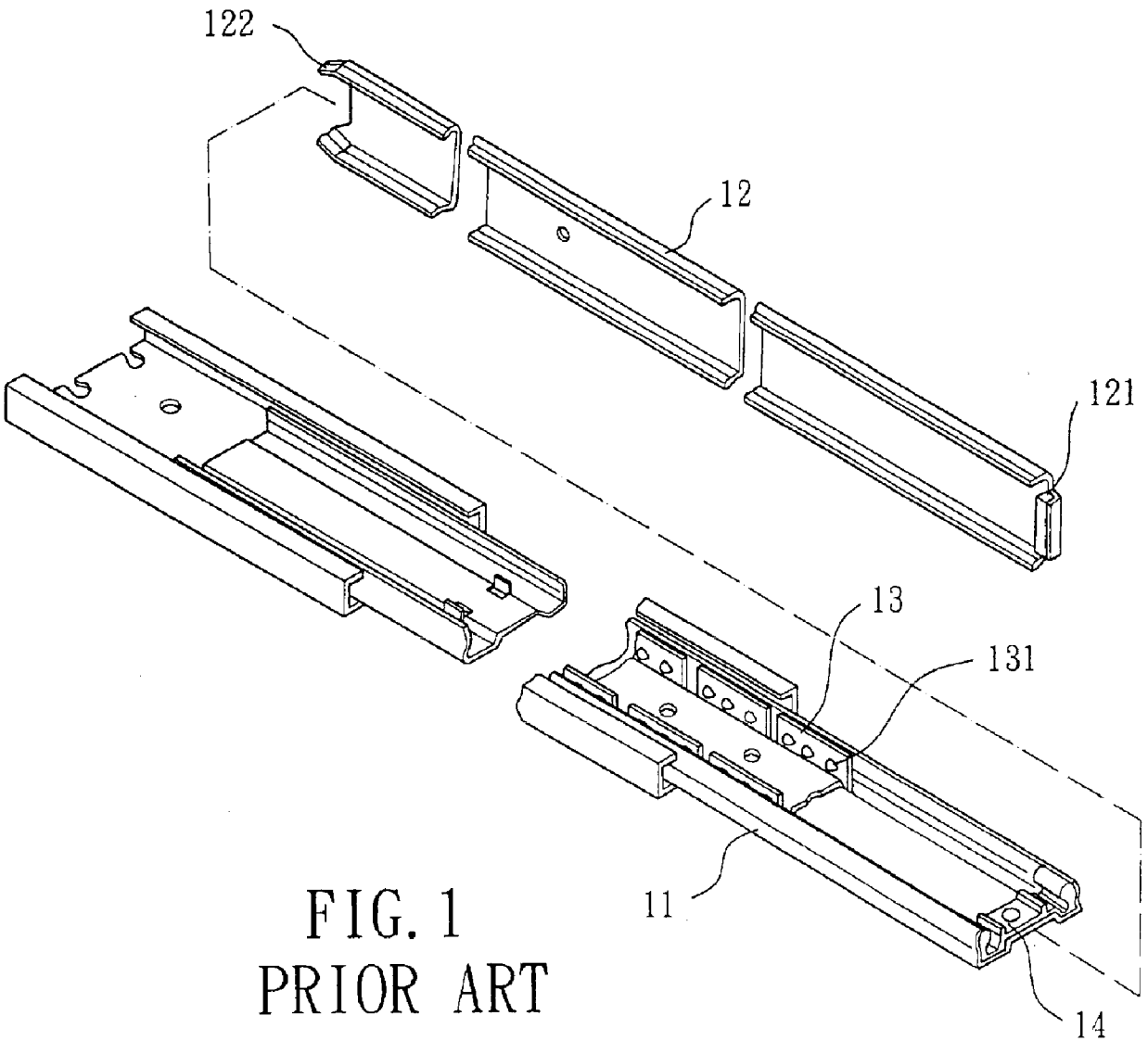
FIG. 1 PRIOR ART
FIG. 1 is an exploded perspective view of a conventional multi-track device for a drawer.
Figure 2:
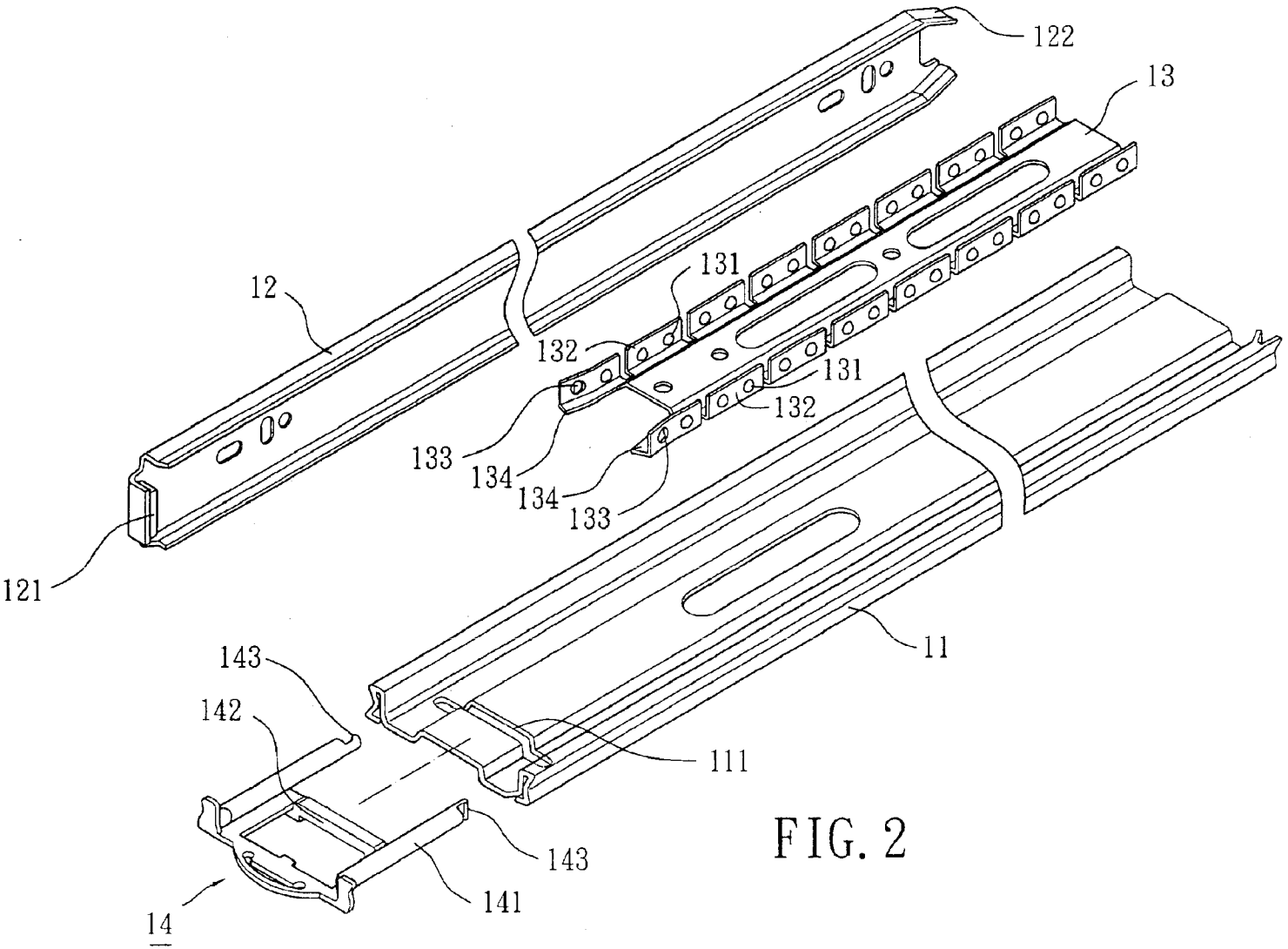
FIG. 2 is an exploded perspective view of a track device for a drawer in accordance with the present invention.
Figure 3:
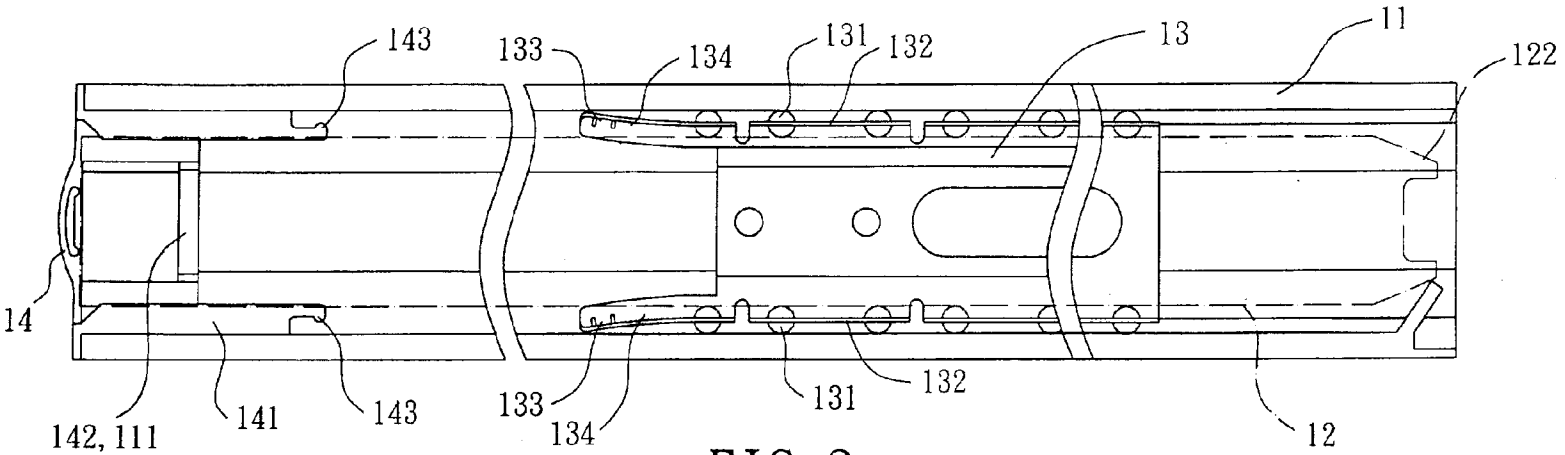
FIG. 3 is a plan view of the track device in accordance with the present invention.

Referring to FIGS. 2 and 3, a track device in accordance with the present invention comprises a first track 11, a second track 12, and a slide-aiding member 13 mounted between the first track 11 and the second track 12 to allow smooth sliding movement of the second track 12 relative to the first track 11. The first track 11 includes a stop member 14 on a front end thereof. The stop member 14 of the first track 11 includes two spaced hooking rods 141 each having a hook 143 on a distal end thereof and an engaging block 142 extended between the spaced rods 141. The first track 11 includes a slot 111 in a front end thereof for securely receiving the engaging block 142 of the first track 11. Nevertheless, the stop member 14 may be fixed onto the first track 11 by tight fitting, screwing, gluing, or any other means.

The slide-aiding member 13 includes a bottom wall (not labeled) and two wings or sidewalls 132 respectively extending from two sides of the bottom wall. A plurality of rolling balls 131 are mounted in each sidewall 132, thereby allowing smooth sliding movement of the second track 12 relative to the first track 11. A front end of the slide-aiding member 13 further includes a forwardly diverging portion 134 (see FIG. 3). Two engaging holes 133 are defined in the forwardly diverging portion 134 of the front end of the slide-aiding member 13, preferably respectively in the sidewalls 132. The slide-aiding member 13 is formed by means of punching a metal plate, with the forwardly diverging portion 134 being bent and with the engaging hole 132 being formed while punching holes (not labeled) for receiving the rolling balls 131 of the slide-aiding member The slide-aiding member 13 and the stop member 14 may be varied in the structures thereof so as to adapt different multi-track devices. The second track 12 includes a stop 121 on a front end thereof. Further, the second track 12 includes a rear end 122 that converges rearward.

Figure 4:
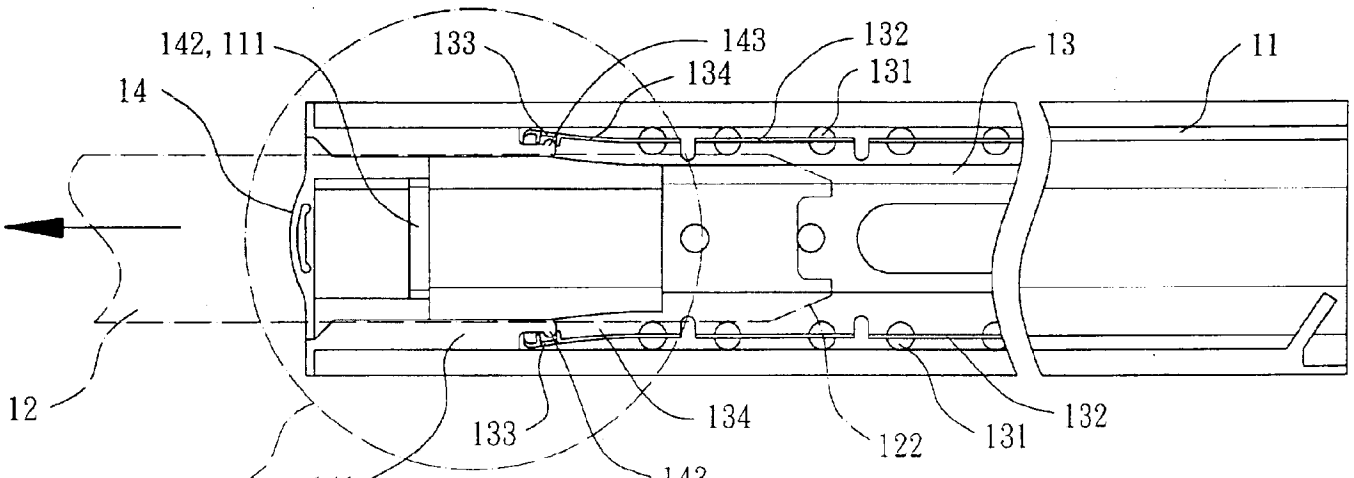
FIG. 4 is a view similar to FIG. 3, illustrating outward sliding movement of the second track relative to the first track.
Figure 5:
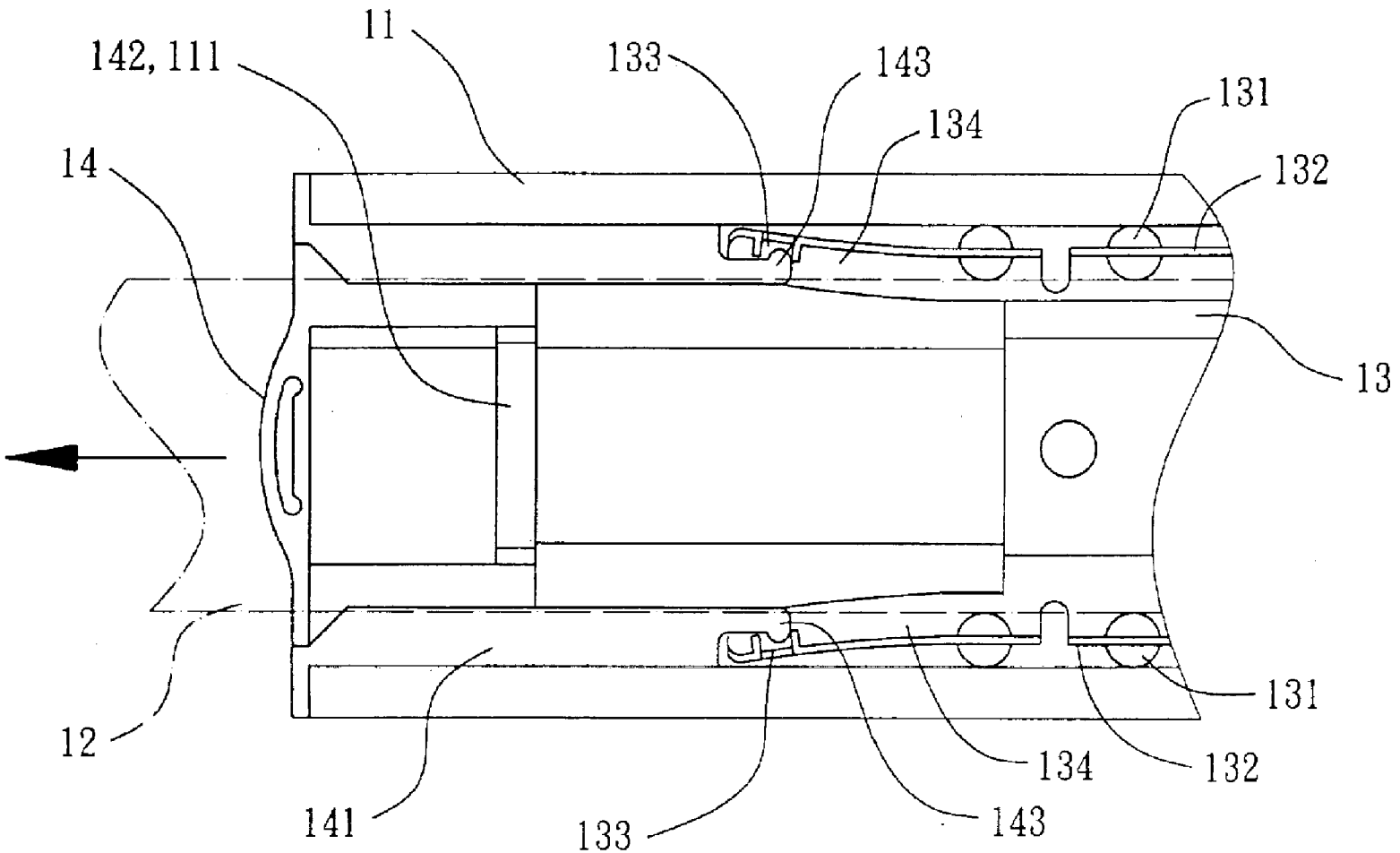
FIG. 5 is an enlarged view of a circled portion in FIG. 4.

Referring to FIG. 3, in normal use, the second track 12 is mounted in the slide-aiding member 13 that is received in the first track 11. The slide-aiding member 13 may slide freely in the first track 11 to allow smooth sliding movement of the second track 12 relative to the first track 11. Referring to FIGS. 4 and 5, when the second track 12 is moved outward (i.e., forward) and thus completely disengaged from the slide-aiding member 13 and the first track 11, the slide-aiding member 13 slides outward (i.e., forward) under the action of the outward moving force of the second track 12 until the forwardly diverging portion 134 of the slide-aiding member 13 abuts against the hooks 141 of the stop member 14. Further forward movement of the slide-aiding member 13 causes the respective hook 141 of the stop member 14 to be engaged into the respective engaging hole 133 of the slide-aiding member 13. The slide-aiding member 13 is thus retained in place while the second track 12 is still moving forward and subsequently disengaged from the slide-aiding member 13 and the first member 11.

Figure 6:
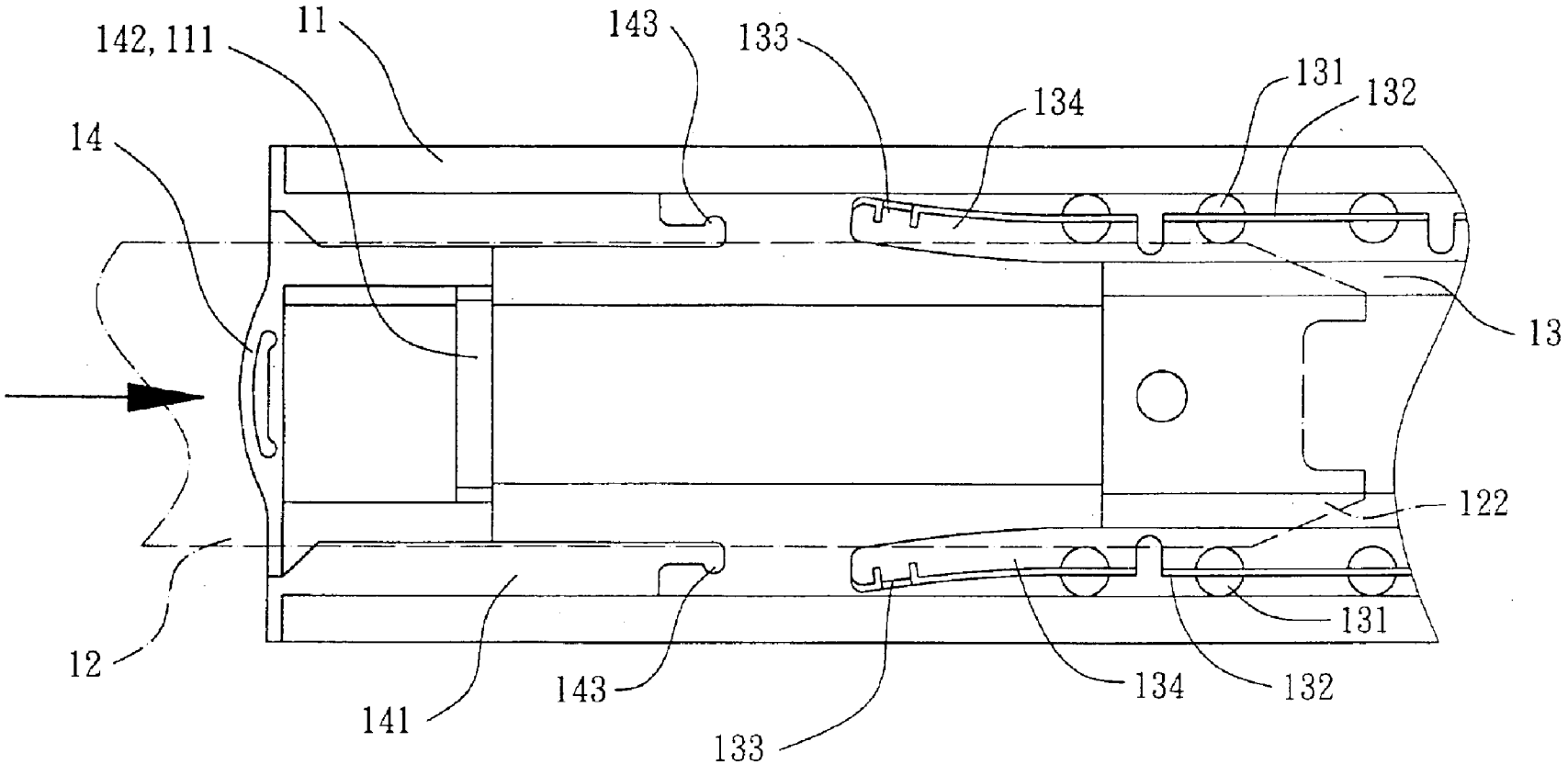
FIG. 6 is a view similar to FIG. 5, illustrating reinsertion of the second track into the slide-aiding member of the track device.

Referring to FIG. 6, when the rear end 122 of the second track 12 is reinserted into the slide-aiding member 13 and the first track 11, the rear end 122 of the second track 12, after passing through the stop member 14 on the first track 11, comes in contact with the rolling balls 131 of the slide-aiding member 13 that is still retained in place. Nevertheless, the inward (i.e., rearward) movement of the second track 12 imparts an inward force to the slide-aiding member 13 to overcome the engaging force between the hooks 143 of the stop member 14 and the engaging holes 133 of the slide-aiding member 13. Eventually, the slide-aiding member 13 is disengaged from the stop member 14 fixed on the first track 11 and slides together with the second track 12. Thus, the track device is again in a state for normal use. Accordingly, the second track 12 can be accurately reinserted into the slide-aiding member 13 that is retained in place through the arrangement of the engaging holes 133 of the slide-aiding member 13 and the hooks 143 of the stop member 14 that together act as a positioning device for the slide-aiding member 13.

Since the forwardly diverging portion 134 of the slide-aiding member 13 is temporarily retained in place by the hooks 143 of the stop member 14, the risk of damage to the front end of the slide-aiding member 13 resulting from inadvertent impingement by the second track 12 during reinsertion of the second track 12 is greatly reduced. Further, the forwardly diverging portion 134 of the slide-aiding member 13 allows easy engagement/disengagement of the hooking rods 141 of the stop member 14 into/from the engaging holes 133 of the slide-aiding member 13.

While the principles of this invention have been disclosed in connection with its specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A track device comprising:

a first track including a stop member fixed on a front end thereof, the stop member including two resilient hooking rods, each said resilient hooking rod has a hook on a distal end extending along a longitudinal direction thereof;

a second track received in the first track, the second track including a front end thereof and a rear end that converges rearward;

a slide-aiding member mounted between the first track and the second track, configured to allow smooth sliding movement of the second track relative to the first track, the slide-aiding member including a front end having a bent fork extending along a longitudinal direction thereof, said bent fork including two engaging through holes thereon; and wherein when the second track is disengaged from the first track, the hooks of the resilient hooking rods of the stop member are passed through the bent fork and then releasably engaged with the engaging through holes of the slide-aiding member to thereby retain the slide-aiding member in place, thereby allowing accurate reinsertion of the second track into the slide-aiding member and the first track.

2. The track device as claimed in claim 1, wherein the front end of the slide-aiding member includes a forwardly diverging portion for allowing easy engagement/disengagement of the hooking rods of the stop member into/from the engaging holes of the slide-aiding member.

3. The track device as claimed in claim 1, wherein the engaging through holes of the slide-aiding member comprise a plurality of punching holes configured for receiving rolling balls of the slide-aiding member.

4. The track device as claimed in claim 1, wherein the stop member further includes an engaging block, and wherein the first track includes a slot for securely receiving the engaging block of the stop member.

* * * * *